US008292039B2

(12) United States Patent
Campbell et al.

(10) Patent No.: US 8,292,039 B2
(45) Date of Patent: Oct. 23, 2012

(54) MAST LIFT AND MAST LIFT SYSTEM

(75) Inventors: Geoffrey George Campbell, Kensington (AU); Hugh Lithgow Stark, Kareela (AU); Alexander McKechran Hardie McNeil, Gladesville (AU); Frank Fornasari, Springwood (AU)

(73) Assignee: JLG Industries, Inc., McConnellsburg, PA (US)

( * ) Notice: Subject to any disclaimer, the term of this patent is extended or adjusted under 35 U.S.C. 154(b) by 1077 days.

(21) Appl. No.: 12/190,217

(22) Filed: Aug. 12, 2008

(65) Prior Publication Data

US 2008/0314690 A1 Dec. 25, 2008

Related U.S. Application Data

(63) Continuation-in-part of application No. PCT/US2007/007060, filed on Mar. 22, 2007.

(60) Provisional application No. 60/784,473, filed on Mar. 22, 2006.

(51) Int. Cl.

| | |
|---|---|
| ***B66B 11/06*** | (2006.01) |
| ***B66B 5/12*** | (2006.01) |
| ***E04G 3/32*** | (2006.01) |
| *B66B 9/16* | (2006.01) |
| *E04G 3/28* | (2006.01) |

(52) U.S. Cl. ..... 187/261; 187/240; 187/361; 187/366; 182/142; 182/148

(58) Field of Classification Search ..... 187/261, 187/263, 361, 366, 371, 373, 376, 367; 182/142, 182/148; 254/266, 334; *E04G 3/28, 3/32*
See application file for complete search history.

(56) References Cited

U.S. PATENT DOCUMENTS

| | | | | |
|---|---|---|---|---|
| 460,647 | A | | 10/1891 | Mills |
| 788,992 | A | | 5/1905 | Bauer |
| 1,744,976 | A | | 1/1930 | Levedahl |
| 2,370,834 | A | | 3/1945 | Ball |
| 2,907,477 | A | * | 10/1959 | Coleman ..... 414/11 |
| 2,938,595 | A | | 5/1960 | Miller |
| 2,989,140 | A | | 6/1961 | Hill et al. |
| 3,115,211 | A | | 12/1963 | Ostrander, Jr. |
| 3,294,182 | A | | 12/1966 | Filander et al. |
| 3,313,376 | A | | 4/1967 | Holland, Sr. |
| 3,737,007 | A | | 6/1973 | Herrell |
| 3,752,263 | A | | 8/1973 | Thevenot |

(Continued)

FOREIGN PATENT DOCUMENTS

| | | |
|---|---|---|
| AU | 725451 | 10/2000 |

(Continued)

*Primary Examiner* — Michael Mansen
*Assistant Examiner* — Stefan Kruer
(74) *Attorney, Agent, or Firm* — Nixon & Vanderhye P.C.

(57) ABSTRACT

A lift system is coupled between a work platform and a mast on a mast lift. The lift system includes at least one lifting rope connected between the work platform and the mast via an idler roller and a hoist drum connected to the work platform. The idler roller is displaceable between an engaged position and a disengaged position based on an amount of tension on the lifting rope. A spring is connected to the idler roller and urges the idler roller toward the engaged position. A carriage latch assembly includes a carriage latch hook coupled with the idler roller and a pin secured to the mast. When the idler roller is disposed in the engaged position, the carriage latch hook is engageable with the pin.

8 Claims, 5 Drawing Sheets

U.S. PATENT DOCUMENTS

| | | | | | |
|---|---|---|---|---|---|
| 3,877,543 | A | * | 4/1975 | Iwata | 182/133 |
| 3,934,681 | A | | 1/1976 | Herrell | |
| 4,015,686 | A | | 4/1977 | Bushnell, Jr. | |
| 4,049,081 | A | | 9/1977 | McDonald et al. | |
| 4,183,423 | A | | 1/1980 | Lewis | |
| 4,194,591 | A | | 3/1980 | Fisher | |
| 4,222,140 | A | * | 9/1980 | Olewinski et al. | 14/71.3 |
| 4,269,285 | A | | 5/1981 | Ohkoshi et al. | |
| 4,427,093 | A | | 1/1984 | Wehmeyer et al. | |
| 4,427,094 | A | | 1/1984 | Winkelblech | |
| 4,484,663 | A | | 11/1984 | Wyse | |
| 4,488,689 | A | | 12/1984 | Councilman | |
| 4,512,440 | A | | 4/1985 | Bixby | |
| 4,592,447 | A | | 6/1986 | Ream et al. | |
| 4,653,653 | A | | 3/1987 | Scott | |
| 4,655,103 | A | | 4/1987 | Schreiber et al. | |
| 4,809,572 | A | | 3/1989 | Sasaki | |
| 5,044,473 | A | | 9/1991 | Gripe | |
| 5,111,907 | A | | 5/1992 | Kishi | |
| 5,143,181 | A | | 9/1992 | Bixby | |
| 5,180,042 | A | | 1/1993 | Ogiso | |
| 5,273,132 | A | | 12/1993 | Sasaki et al. | |
| 5,313,765 | A | | 5/1994 | Martin | |
| 5,425,433 | A | | 6/1995 | Huber | |
| 5,522,583 | A | | 6/1996 | Martin | |
| 5,588,496 | A | | 12/1996 | Elger | |
| 5,595,265 | A | * | 1/1997 | Lebrocquy | 187/261 |
| 5,755,306 | A | | 5/1998 | Kraemer et al. | |
| 5,762,556 | A | | 6/1998 | Kurian | |
| 5,803,204 | A | | 9/1998 | White et al. | |
| 5,850,892 | A | | 12/1998 | Citron et al. | |
| 5,890,559 | A | | 4/1999 | Busuttil et al. | |
| 5,909,783 | A | | 6/1999 | Berish | |
| 5,927,440 | A | | 7/1999 | Freeman | |
| 6,095,284 | A | | 8/2000 | Smith | |
| 6,174,124 | B1 | | 1/2001 | Haverfield et al. | |
| 6,238,159 | B1 | | 5/2001 | Pappas | |
| 6,471,004 | B2 | | 10/2002 | Stringer et al. | |
| 6,779,635 | B1 | | 8/2004 | Anibas | |
| 6,948,392 | B2 | | 9/2005 | Eckard et al. | |
| 2007/0104539 | A1 | * | 5/2007 | Hamilton | 405/3 |
| 2007/0125599 | A1 | | 6/2007 | Campbell et al. | |

FOREIGN PATENT DOCUMENTS

| | | |
|---|---|---|
| EP | 0 192 170 | 8/1986 |
| EP | 0 931 757 | 7/1999 |
| FR | 2 081 769 | 12/1971 |
| GB | 905928 | 9/1962 |
| GB | 2 211 237 | 6/1989 |
| JP | 63-258315 | 10/1988 |
| JP | 2002-167140 | 6/2002 |

* cited by examiner

MAST LIFT AND MAST LIFT SYSTEM

CROSS-REFERENCES TO RELATED APPLICATIONS

This application is a continuation-in-part of PCT International Patent Application No. PCT/US2007/007060 filed Mar. 22, 2007 which claims the benefit of U.S. Provisional Patent Application Ser. No. 60/784,473, filed Mar. 22, 2006, the entire content of each of which is herein incorporated by reference.

STATEMENT REGARDING FEDERALLY SPONSORED RESEARCH OR DEVELOPMENT (Not Applicable)

BACKGROUND OF THE INVENTION

The present invention relates to a personnel lift and, more particularly, to a portable lift machine including a work platform raised and lowered on a mast by a lifting system. The lifting machine may be free-standing or non free-standing, transportable and operable by a single user.

The ladder concept is several thousand years old. Existing ladders, however, can be cumbersome and difficult to maneuver. Additionally, conventional ladders can be unstable particularly on uneven ground, and a work area is limited to the user's reach.

Ladder companies are reluctant to develop powered mechanical products. It would be desirable, however, to develop a personnel lift that achieves many of the advantages of a ladder, e.g., can be set up and used by a single operator, lightweight, etc., while providing for greater stability and a larger working area in a portable powered machine.

Mast climbing platforms are known and typically include a mast that can be free-standing or supported by a wall or other support structure. However, existing mast climbers have minimum SWL loads of 1000 lbs and are not portable or operable by a single user due to their size. Vertical mast products and aerial work platforms include a moving platform and generally are only free-standing assemblies. These machines are also typically too large for portability and are very far from the many advantages provided by a ladder in terms of portability, low cost and ease of use.

To achieve portability, a light weight, reliable lift system mechanism is desirable to provide the functionality expected of a device which lifts personnel.

SUMMARY OF THE INVENTION

A mast lift includes a base or mast frame, a mast on which a carriage supporting a work platform is movable, and a power source, which may be an on-board power pack or a user-supplied source such as a power drill. The various components can also be utilized as part of a modular system where modular components can be used in varying models.

Exemplary features of the carriage and lifting system include the use of an overload clutch in combination with an overrun brake to avoid the lifting mechanism such as a rope or the like from being unwound off a winding drum after reaching the bottom of travel or if encountering an obstacle. An emergency brake secures the work platform to the mast in the event of loss of rope tension or rope failure, engagement of which to the mast at the bottom of travel serves to both stop the further unwinding of the rope from the drum and also to provide a latch to hold the carriage in the down position during transport, etc.

An energy absorbing feature may be provided between the platform and the carriage that reduces the peak impact load that can be exerted on the structure. This feature provides a type of elastic bumper and/or crumple zone in the unlikely event of complete hoist rope failure and emergency brake deployment.

Another exemplary feature is spring-mounted stepped rollers for a telescopic mast.

In an exemplary embodiment, a mast lift, includes a mast supported on a mast base, a work platform movably secured to the mast, and a lift system coupled between the work platform and the mast. The lift system effects raising and lowering of the work platform on the mast. The lift system includes at least one lifting rope connected between the work platform and the mast via a brake frame and a hoist drum connected to the work platform, where the brake frame is displaceable between an engaged position and a disengaged position based on an amount of tension on the lifting rope. The lift system additionally includes a spring connected to the brake frame that urges the brake frame toward the engaged position, and a lift system or carriage latch assembly including a carriage latch hook coupled with the brake frame and a pin secured to the mast. When the brake frame is disposed in the engaged position, the carriage latch hook is engageable with the pin to form a latch between the movable platform carriage and the mast. This latching system stops travel of the carriage along the mast when, for example, the mast is being transported The lift system preferably includes a worm drive gear box operably connected to the hoist drum, where the gear box is driven via a drive shaft coupleable with a drive source. The lift system may include two or more lifting ropes. In one arrangement, the mast lift additionally includes an idler roller cooperable with the brake frame and displaceable with the brake frame between the engaged position and the disengaged position, where the idler roller is biased toward the engaged position, and where the lifting rope is cooperable with the idler roller such that tension on the lifting rope maintains the brake frame in the disengaged position.

The drive source may be one of a power pack or a hand-held power drill. In this context, the drive shaft may be biased toward a disengaged position such that activation of the drive shaft requires an opposite force against the bias.

The mast base is preferably structured such that the mast lift is free-standing, although the mast lift can be free standing or leaning.

In another exemplary embodiment, a lift system coupleable between a work platform and a mast effects raising and lowering of the work platform on the mast. The lift system includes at least one lifting rope connected between the work platform and the mast; an emergency brake cooperable with the at least one lifting rope and movable between an engaged position engaging the mast and a disengaged position disengaging the carriage from the mast based on an amount of tension on the lifting rope; and a carriage latch assembly cooperable with the emergency brake, the carriage latch assembly automatically locking the work platform to the mast when the work platform reaches a lowermost position. The lift system may additionally include a rope tension sensing device such as an idler roller coupled to and movable with the emergency brake between the engaged position and the disengaged position.

In one arrangement, the carriage latch assembly includes a carriage latch hook coupled with the idler roller and a pin secured to the mast. When the idler roller is disposed in the engaged position, the carriage latch hook is engageable with the pin or pins on the mast. There may be multiple pins at various heights and could be on one side or both sides of the mast. In another arrangement, the carriage latch assembly is structured to automatically release the work platform when a lifting tension is applied to the lifting rope.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
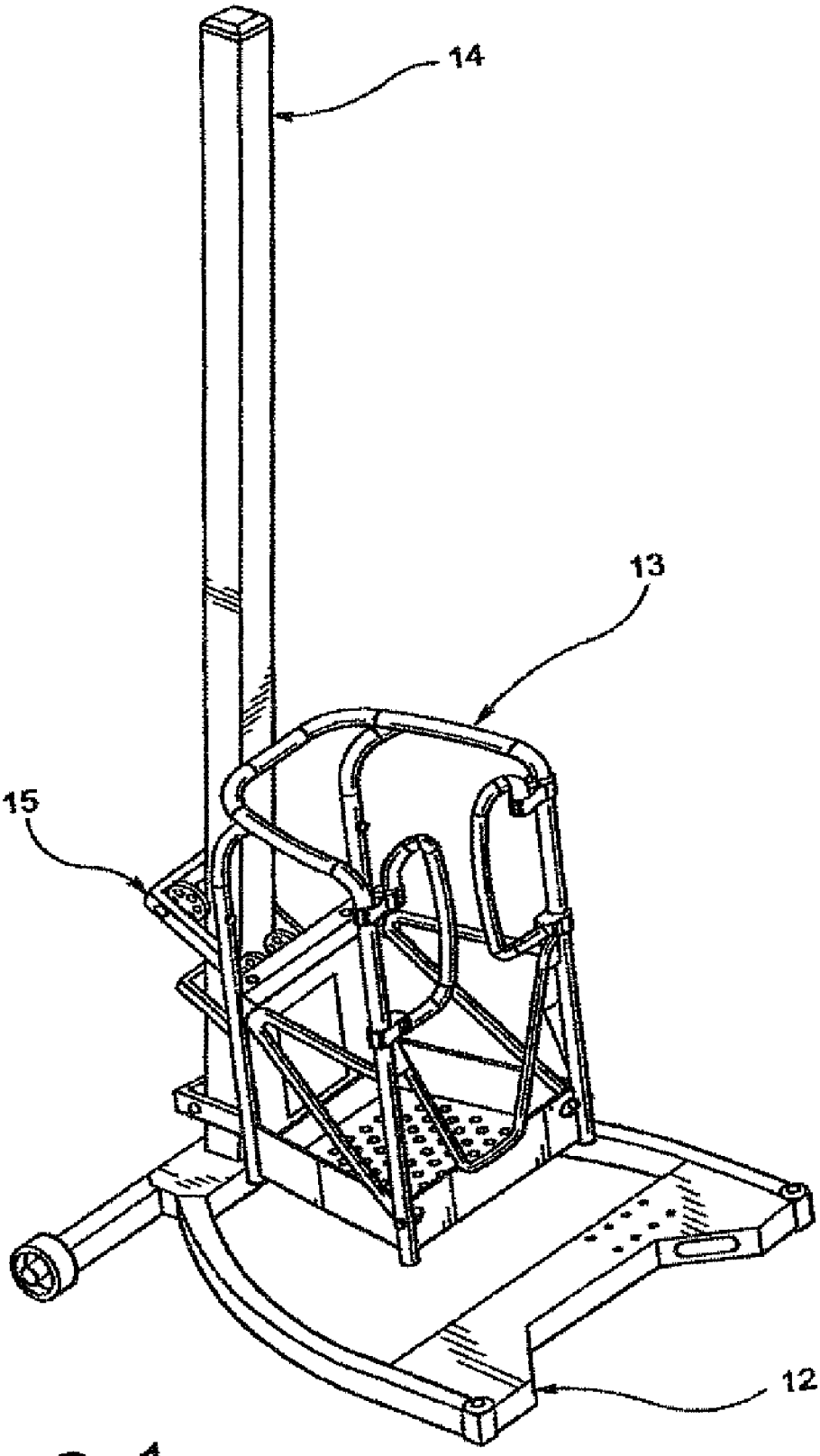
FIG. 1 is a perspective view of the mast lift according to an exemplary configuration.
Figure 2:
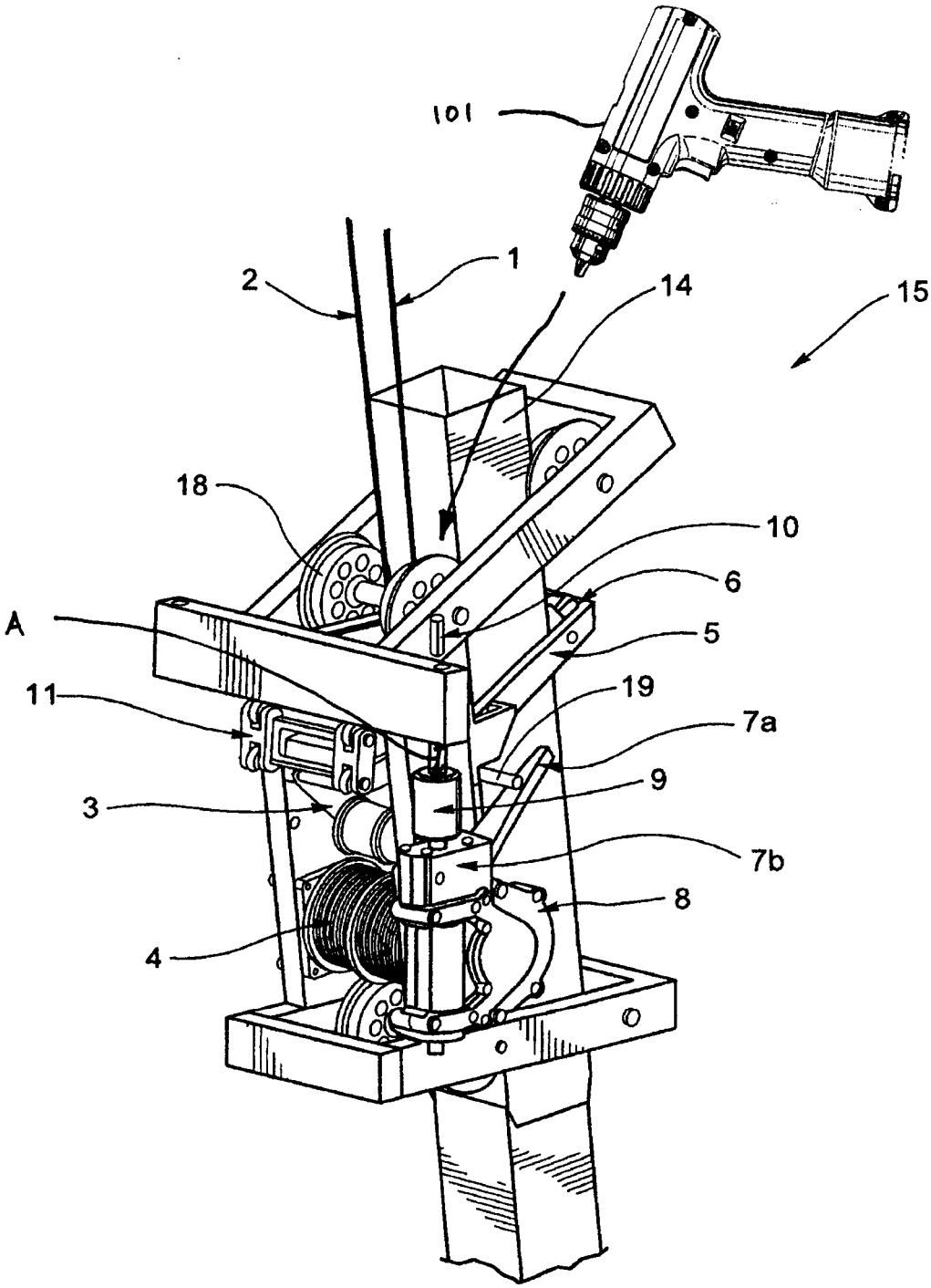
FIG. 2 is a front perspective view of a lifting system for the mast lift.

With reference to FIG. 1, the mast lift described herein generally includes a base or mast frame 12 supporting a mast 14 on which a work platform 13 is movable between a lowered position (shown in FIG. 1) and a raised position via a carriage assembly or lift system 15. Preferably, the components are modular, thereby enabling the machine to be quickly and reliably assembled and disassembled for ease of transport by one person. Component assembly typically takes the average skilled worker less than 30 seconds. The modular system also allows various components to be used on different types of mast and base designs, increasing product versatility. In an alternative embodiment, the mast 14 includes telescoped sections to provide for a greater height mast that can retract to be more compact for transport. The mast lift shown in FIG. 1 is a free-standing mast lift, i.e., the machine is capable of independent support and positioning. The components of the lifting structure described below are equally applicable to a non free-standing machine, and the invention is not necessarily meant to be limited to the illustrated exemplary free-standing lift embodiment.

The base or mast frame 12 is provided with a one-way retracting castor system. This ensures no sprung castor support to the platform when a user is on the platform. With no user on the platform, a simple activation deploys the castor for case of relocation of the lift.

The work platform 13 is secured to the carriage or lift system 15 via mounting pins, a hook and a latch, all of which engage during a simple assembly operation that takes less than ten seconds to complete safely, and cannot readily be incorrectly assembled in an unsafe manner. With reference to FIGS. 2-5, one or preferably two lifting ropes 1, 2 are connected at the top of the mast 14 via a tension equalizing loop (not shown) that ensures equal tension on each rope while maintaining independent rope terminations at the top of the mast 14. The ropes 1, 2 extend along the front of the mast 14 and into the carriage 15. Rollers 18 mount the carriage 15 onto the mast 14 and also ensure that the platform 13 does not rotate around the mast 14. The rollers 18 are preferably stepped and spring-loaded to act on the telescopic variation.

The ropes 1, 2 preferably pass over an emergency brake release idler roller 3 before being wrapped onto a main hoist drum 4. Platform lift is achieved by a worm drive gear box 8 turning the hoist drum 4 to wind the lifting ropes 1, 2. In a preferred embodiment, the hoist drum 4 is grooved to help ensure that the ropes 1, 2 wind onto the drum 4 in a first layer of constant diameter until the middle of the drum is reached, after which the ropes 1, 2 may roll back onto themselves forming a second layer.

The worm drive gear box 8 is driven via a drive shaft 10, which may be activated by a modular power pack or alternatively via a hand-held power drill 101 or the like. The drive shaft 10 is provided with two-action operation, requiring the shaft to be pushed down to engage the worm drive gear box 8 and rotated. Using a hand-held power drill, the two-action activation requires that the operator push down on the shaft and pull the trigger on the drill to move the platform 13 (as shown by arrow A in FIG. 2). The operator is protected from excessive backlash torque if he fails to activate the second action via the overload clutch, which slips if the second action is not properly completed. With the power pack, securing the power pack to the drive shaft 10 fixes the drive shaft in the pushed down position for activation. The gear box 8 preferably also has an input on the bottom side to allow manual descent from underneath in the event of an incapacitated operator.

Tension on the lifting ropes 1, 2 is sensed by any suitable device. In one construction, the lifting rope tension exerts a force through an idler roller 3 on a bell crank 17, which operates in cooperation with an emergency brake frame or idler roller frame 5 and its mounting link 11 to cause brake shoes 6 to be released from the mast 14 and remain released from the mast 14 while tension remains on the lifting ropes 1, 2. As such, this configuration permits the carriage 15 to move freely in normal use.

The idler roller 3 may be eliminated with the use of a swinging brake frame 5 that is disengaged by tension on the lifting ropes 1, 2 and engaged when tension is lost. That is, in the event that tension in the ropes 1, 2 is lost, a spring 29 attached between the top front roller 18 axle and the brake frame 5 via the link 11 causes the brake shoes 6 to come into contact with the mast 14, and due to the high friction between the shoes 6 and the mast 14, and the weight of the platform applied via link 11 to the front of the emergency brake frame 5 cause cross-binding of the emergency brake frame 5 around the mast 14 to occur, so locking the emergency brake frame 5 to the mast 14. The load on the platform 13 is then no longer supported by tension in the ropes 1, 2, but rather is supported by the mast 14 via the mounting link 11, the emergency brake frame 5 and the brake shoes 6.

Figure 6:
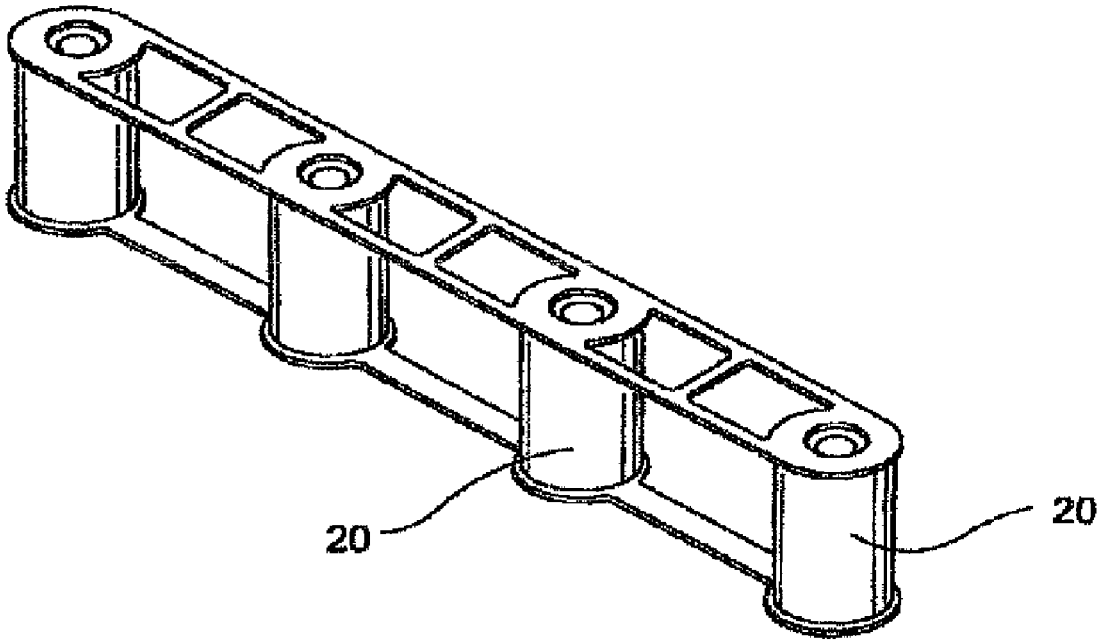
FIG. 6 shows an energy absorbing member.

The system is designed so that the emergency brake engages within a very short amount of fall following loss of tension in the lifting ropes 1, 2, which helps to minimize the impact forces from activation of the emergency brake. Energy from the rapid deceleration caused by the engagement of the self-energizing emergency brake could be damaging to the machine given the high peak forces that can be applied in an emergency engagement of the brake. The configuration described herein minimizes the extent of peak loading by incorporating an energy absorbing member 20 such as energy absorbing rubber springs mounted between the carriage 15 and the platform 13 as shown in FIG. 6. An additional benefit of the energy absorbing rubber springs 20 when combined with other features in the design is a crumple zone effect to restrain the maximum G forces on the user in the event of catastrophic failure (akin to a crumple zone in a modern car).

With continued reference to FIGS. 2-5, an overload clutch 9 operates on the drive shaft 10 to ensure that no more than a maximum safe working load plus a small margin can be lifted by the hoist drum 4. The overload clutch 9 transmits the drive torque into the gear box 8 via the drive shaft 10 in a preferred embodiment of the concept but could be incorporated in another part of the drive chain to achieve the same outcome. Any suitable device could be used for the overload clutch 9, and the invention is not meant to be limited to a specific design. In one construction, a series of interleaved spring-loaded washers or the like in an oil bath serve as an overload clutch, wherein upon application of a predetermined load (torque), the washers slip relative to one another.

An over-run brake 7 is also incorporated in the drive train. The over-run brake 7 acts to stop the lifting ropes 1, 2 from being wound off the drum 4 when the machine is fully lowered to the bottom of travel and also in the unlikely event of the platform 13 being hung up on an obstacle during downward travel. The over-run brake 7 senses a loss of tension in the ropes 1, 2 via the emergency brake mechanism 5 via a pin 19 or other engaging component acting on a lever arm 7*a*, which is spring loaded to engage the emergency brake frame 5. When tension is lost in the ropes 1, 2, normally only due to reaching the bottom of travel, the emergency brake frame 5 moves to its engaged position, which causes an over-run brake lever 7*a* to lower a dog-clutch 7*b* onto the drive shaft 10 so that the drive shaft 10 is prevented from further rotating. Power from the drive motor then is absorbed by the slipping overload clutch 9, which while slipping creates a noise that should lead the operator to stop operating the motor.

The dog-clutch 7*b* is preferably a one-way dog-clutch device that allows travel in the lift up direction when it is activated, and prevents travel in the lift down direction when it is activated, hence avoiding the ropes 1, 2 becoming slack, running out or winding to the end of the drum 4. This design enables the operator to lift up from a position in which the over-run brake 7 is engaged as this in turn creates tension on the ropes 1, 2, which in turn releases the emergency brake (and carriage to mast latch) and releases the over-run brake 7.

Figure 3:
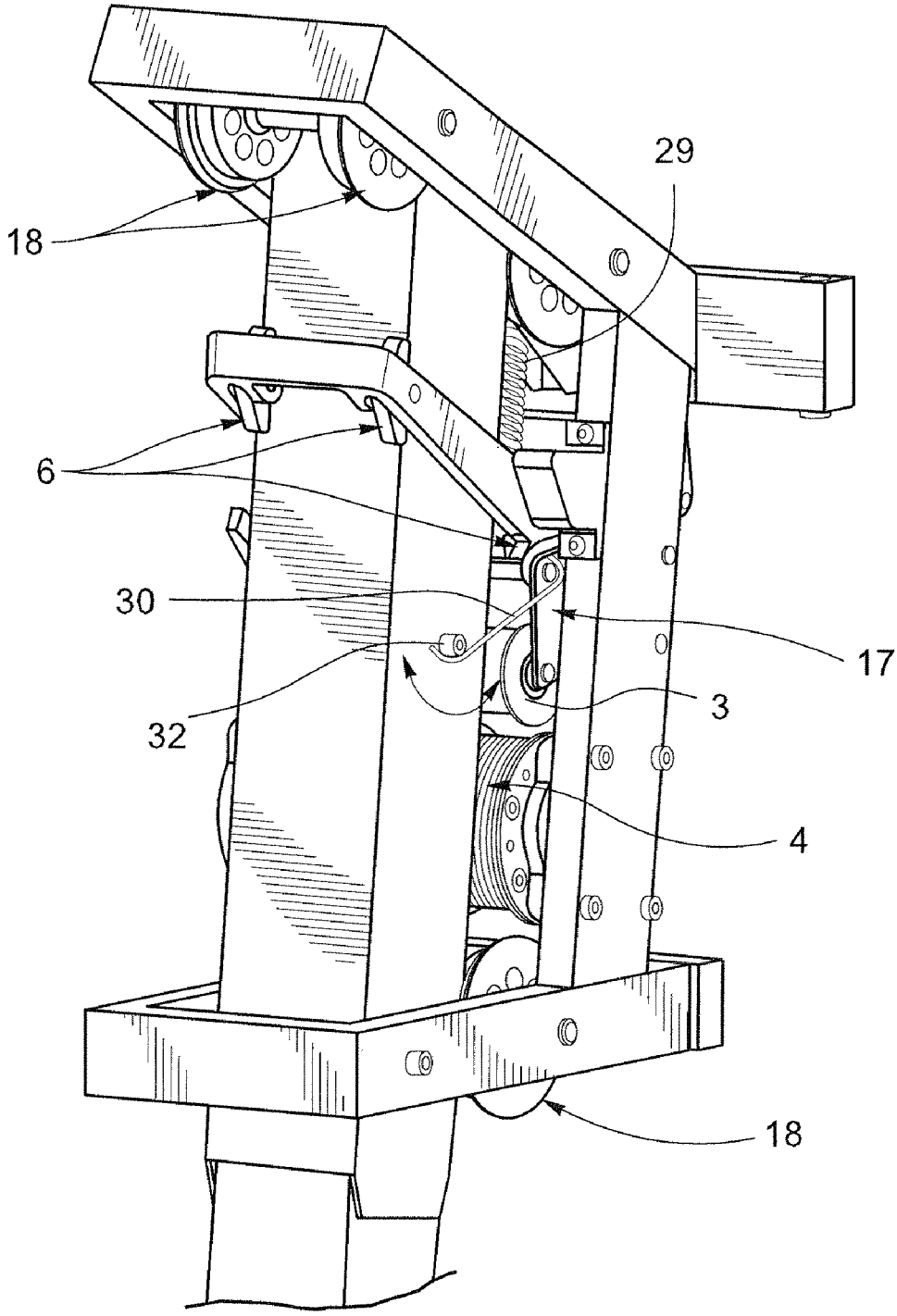
FIG. 3 is a rear perspective view of the lifting system.
Figure 4:
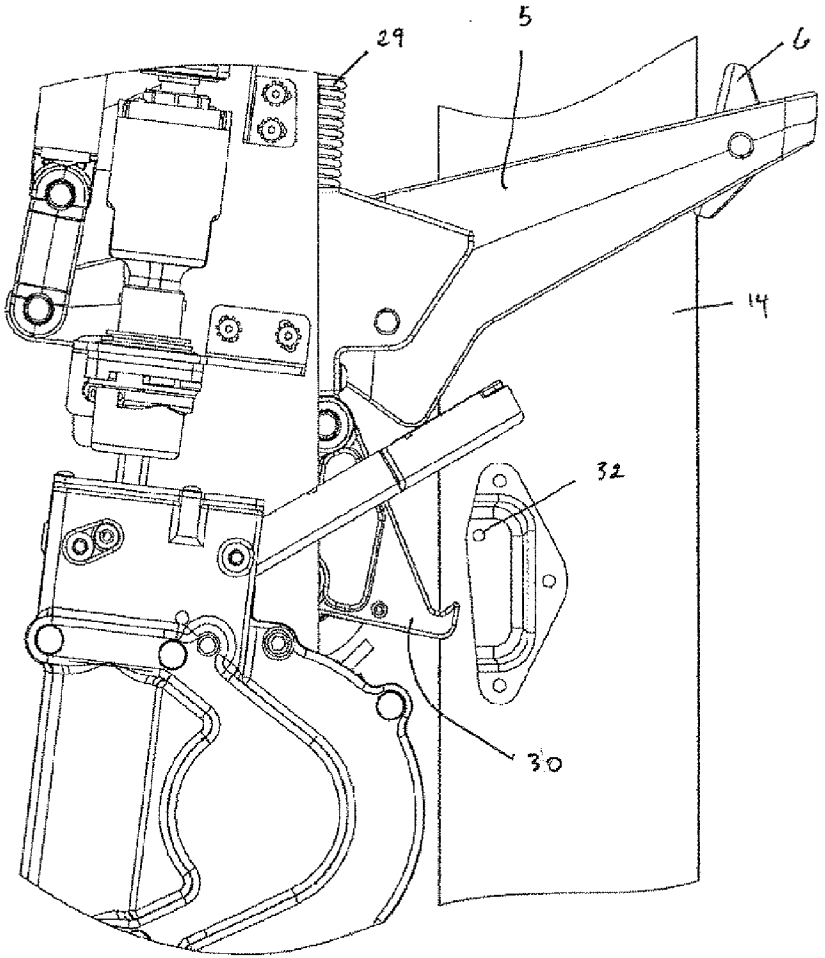
FIG. 4 is a side view of the lifting system.
Figure 5:
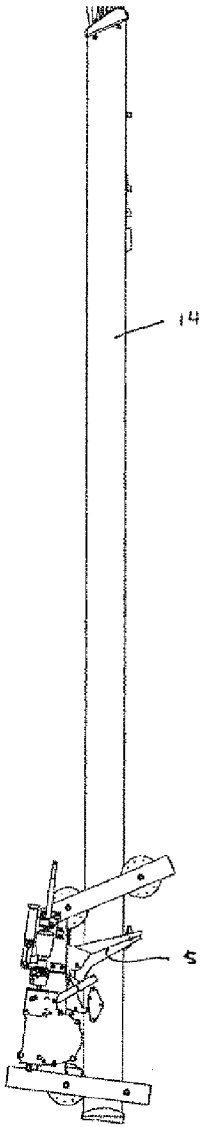
FIG. 5 is a side view of the lifting system on the mast.

The idler roller 3 is displaceable between an emergency brake engaged position when ropes 1, 2 are under low tension and a disengaged position when ropes 1, 2 are supporting the weight of the loaded platform. At the bottom of travel, the platform rests on the base causing low tension in ropes 1, 2 so causing the idler roller mount or bell crank 17 to rotate consistent with the emergency brake engaged position. The bell crank 17 is utilized in this position to latch the carriage 15 to the mast 14 when the platform is in the fully lowered position. That is, as shown in FIGS. 3-4, when tension in ropes 1, 2 is lost, typically due to reaching the bottom of travel, the emergency brake frame 5 is pivoted (clockwise in FIG. 3) by action of the spring 29 preferably attached between the top front roller 18 axle and the brake frame 5 (although the spring could attach from anywhere on the carriage), which in turn causes a carriage latch assembly 30, 32 (shown schematically in FIG. 3) including a carriage latch hook 30 attached to the bell crank 17 to swing inward toward a center of the mast 14. When the carriage is at the bottom of travel, this movement brings the carriage latch hook 30 under a pin or pins 32 of the assembly located on the mast 14. Thus, at the bottom of travel, the carriage is automatically latched to the mast 14. When the operator drives the platform 13 up the mast 14, tension in the ropes 1, 2 moves the emergency brake frame 5 (counterclockwise in FIG. 3) against the force of the spring 29, which in turn releases the carriage latch hook 30. This structure provides an added benefit of ensuring that the carriage does not move when the mast is lifted off the base holding the carriage. It also stops the carriage from moving along the mast during transport.

The overall result of the design is a carriage that can climb a mast with one or more, preferably two, lift ropes plus an emergency brake, plus control of overload, end of travel control, over-run control and auto on/off lock down latch at the bottom of travel. The simple mechanism includes all these features yet weighs only about 30 lbs.

As described, the configuration achieves these important safety and operational functions without the use of any electric or electronic devices, thereby keeping the design simple from a cost, weight and maintenance perspective. As would be apparent to those of ordinary skill in the art, however, use of electric or electronic devices to perform these functions is possible, and the invention is not necessarily meant to be limited to the described configuration.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A mast lift comprising:

a mast supported on a mast base;

a work platform movably secured to the mast;

a lift system coupled between the work platform and the mast, the lift system effecting raising and lowering of the work platform on the mast and including:

at least one lifting rope connected between the work platform and the mast via a brake frame and a hoist drum connected to the work platform, wherein the brake frame is displaced between an engaged position and a disengaged position based on an amount of tension on the lifting rope, a spring connected to the brake frame and urging the brake frame toward the engaged position, and a carriage latch assembly including a carriage latch hook coupled with the brake frame and a pin secured to the mast, wherein when the tension on the lifting rope is lost upon the work platform reaching a bottom of travel, the brake frame is disposed in the engaged position, and the carriage latch hook is displaced into engagement with the pin, and an idler roller cooperable with the brake frame and displaceable with the brake frame between the engaged position and the disengaged position, wherein the idler roller is biased toward the engaged position, and wherein the lifting rope is cooperable with the idler roller such that tension on the lifting rope maintains the brake frame in the disengaged position.

2. A mast lift according to claim 1, wherein the lift system comprises a worm drive gear box operably connected to the hoist drum, the gear box being driven via a drive shaft coupled with a drive source.

3. A mast lift according to claim 2, wherein the drive source is one of a power pack or a hand-held power drill.

4. A mast lift according to claim 3, wherein the drive shaft is biased toward a disengaged position such that activation of the drive shaft requires a force against the bias.

5. A mast lift according to claim 1, wherein the lift system comprises two lifting ropes.

6. A mast lift according to claim 1, wherein the mast base is structured such that the mast lift is free-standing.

7. A lift system coupleable between a work platform and a mast, the lift system effecting raising and lowering of the work platform on the mast, wherein the lift system comprises:

at least one lifting rope connected between the work platform and the mast;

an emergency brake cooperable with the at least one lifting rope and movable between an engaged position engaging the mast and a disengaged position disengaging the mast based on an amount of tension on the lifting rope;

a carriage latch assembly cooperable with the emergency brake, the carriage latch assembly automatically locking the work platform to the mast when the work platform reaches a lowermost position; and an idler roller coupled to and movable with the emergency brake between the engaged position and the disengaged position, the idler roller being cooperatively engaged with the at least one lifting rope such that the tension in the lifting rope displaces the idler roller to maintain the emergency brake in the disengaged position, wherein the carriage latch assembly comprises a carriage latch hook coupled with the idler roller and a pin secured to the mast, wherein when the idler roller is disposed in the engaged position, the carriage latch hook is engageable with the pin.

8. A lift system according to claim 7, wherein the carriage latch assembly is structured to automatically release the work platform when a lifting tension is applied to the lifting rope.

* * * * *